US010429796B2

(12) United States Patent
Cusin et al.

(10) Patent No.: US 10,429,796 B2
(45) Date of Patent: Oct. 1, 2019

(54) TIMEPIECE COMPONENT WITH A PART HAVING AN IMPROVED WELDING SURFACE

(71) Applicant: Nivarox-FAR S.A., Le Locle (CH)

(72) Inventors: Pierre Cusin, Villars-Burquin (CH); Davy Cretenet, La Chaux-de-Gilley (FR); Marc Stranczl, Nyon (CH); Raphael Garret, La Chaux-de-Fonds (CH)

(73) Assignee: Nivarox-FAR S.A., Le Locle (CH)

( * ) Notice: Subject to any disclaimer, the term of this patent is extended or adjusted under 35 U.S.C. 154(b) by 10 days.

(21) Appl. No.: 15/171,032

(22) Filed: Jun. 2, 2016

(65) Prior Publication Data

US 2016/0370763 A1 Dec. 22, 2016

(30) Foreign Application Priority Data

Jun. 16, 2015 (EP) ..... 15172319

(51) Int. Cl.
*G04B 17/34* (2006.01)

(52) U.S. Cl.
CPC ..... *G04B 17/34* (2013.01)

(58) Field of Classification Search
CPC .... G04B 13/02; G04B 13/022; G04B 13/026; G04B 17/32; G04B 17/325; G04B 17/34
See application file for complete search history.

(56) References Cited

U.S. PATENT DOCUMENTS 4,648,722 A * 3/1987 Mock ..... B29C 65/08 368/236
4,999,823 A * 3/1991 Grosjean ..... G04B 37/0008 368/281
5,077,711 A * 12/1991 Grosjean ..... G04B 37/226 368/281
5,500,837 A * 3/1996 Flury ..... G04B 29/027 368/276
5,696,741 A * 12/1997 Nussbaum ..... G04B 37/081 368/276
5,855,430 A 1/1999 Coushaine et al.
6,053,631 A * 4/2000 Mock ..... G04B 19/14 368/281
6,528,931 B1 3/2003 Umehara et al.
6,710,526 B1 3/2004 Helbig
(Continued)

FOREIGN PATENT DOCUMENTS

CH 698 677 B1 9/2009
CH 706 846 A1 2/2014
(Continued)

OTHER PUBLICATIONS

European Search Report dated Mar. 29, 2016 in European Application 15172319, filed Jun. 16, 2015 (with English Translation and Written Opinion).

*Primary Examiner* — Edwin A. Leon
*Assistant Examiner* — Jason M Collins
(74) *Attorney, Agent, or Firm* — Oblon, McClelland, Maier & Neustadt, L.L.P.

(57) ABSTRACT

The invention relates to a timepiece component with a part including at least one face with a geometry capable of ensuring that the part is fitted in an isostatic configuration onto a member to improve the welding thereof.

12 Claims, 5 Drawing Sheets

(56) References Cited

U.S. PATENT DOCUMENTS

| | | | | |
|---|---|---|---|---|
| 7,950,847 | B2 * | 5/2011 | Zaugg | G04D 3/0041 216/2 |
| 8,277,117 | B2 * | 10/2012 | Verardo | G04B 13/021 368/320 |
| 2011/0103200 | A1 | 5/2011 | Cusin | |
| 2013/0153289 | A1 * | 6/2013 | Poli | G04B 39/004 174/565 |

FOREIGN PATENT DOCUMENTS

| | | | |
|---|---|---|---|
| DE | 199 51 203 | A1 | 4/2001 |
| EP | 0 860 651 | A2 | 6/2006 |
| EP | 0 860 651 | B1 | 6/2006 |
| EP | 2 107 433 | A1 | 10/2009 |
| EP | 2 317 406 | A1 | 5/2011 |
| WO | WO 2015/185423 | A3 | 12/2015 |

* cited by examiner

TIMEPIECE COMPONENT WITH A PART HAVING AN IMPROVED WELDING SURFACE

This application claims priority from European Patent Application No 15172319.4 filed Jun. 16, 2015, the entire disclosure of which is hereby incorporated herein by reference.

FIELD OF THE INVENTION

The invention relates to a timepiece component with a part having an improved welding surface and, more specifically, such a part whose surface can be adapted for improved welding.

BACKGROUND OF THE INVENTION

It is known from WO Publication 2015/185423 how to form a timepiece component from a part comprising a silicon-based or ceramic-based material which is welded by electromagnetic radiation directly onto another part, such as, for example, a metal or a metal alloy.

In the context of this development, it transpired that it was important for the gap between the parts not to exceed 0.5 micrometer, otherwise they could not be welded together.

SUMMARY OF THE INVENTION

It is an object of the present invention to overcome all of part of aforecited drawbacks by proposing a timepiece component comprising a new part with at least one contact surface that allows for geometric adaptation to ensure the assembly thereof by welding to another member.

To this end, according to a first embodiment, the invention relates to a timepiece component comprising a part fitted and welded onto a member provided with a substantially horizontal surface and a substantially vertical surface, characterized in that the part includes at least one face with a substantially rectilinear wall adjacent to an oblique wall so as to ensure that the part is fitted in an isostatic configuration to improve the welding thereof onto the member.

According to the first embodiment, the part advantageously offers a face with a reduced welding surface combined with an isostatically configured fit of the part to decrease the gap to a value that ensures the welding thereof onto a member.

Further, according to a second embodiment, the invention relates to a timepiece component comprising a part fitted and welded onto a member provided with a substantially horizontal surface and a substantially vertical surface, characterized in that the part includes at least one face with a substantially rectilinear wall that is partially pierced so as to ensure that the part is fitted in an isostatic configuration to improve the welding thereof on to the member.

According to the second embodiment, the part advantageously offers a flexible portion capable of adapting to the geometry of a member combined with an isostatically configured fit of the part to decrease the gap to a value that ensures the welding thereof onto a member.

In accordance with other advantageous variants of the invention:

said at least one face of the part is fitted onto the substantially vertical surface or onto the substantially horizontal surface of the member;

the part is made from silicon or from ceramic;

the part also includes at least a partial coating of metal, silicon oxide, silicon nitride, silicon carbide or an allotrope of carbon;

the member includes an iron alloy, a copper alloy, nickel or an alloy thereof, titanium or an alloy thereof, gold or an alloy thereof, silver or an alloy thereof, platinum or an alloy thereof, ruthenium or an alloy thereof, rhodium or an alloy thereof, or palladium or an alloy thereof.

BRIEF DESCRIPTION OF THE DRAWINGS

Other features and advantages will appear clearly from the following description, given by way of non-limiting illustration, with reference to the annexed drawings, in which.

DETAILED DESCRIPTION OF PREFERRED EMBODIMENTS

The invention relates to a component formed with the aid of a part made of a material having no usable plastic range, i.e. a very limited plastic range, and another part comprising the same type of material or a different type of material.

This component was devised for applications in the field of horology and is rendered necessary by the increasing part played by fragile, brittle materials, such as silicon-based or ceramic-based materials. It is possible, for example, to envisage forming a case, a dial, a flange, a crystal, a bezel, a push-button, a crown, a case back, a hand, a bracelet or strap, a balance spring, a balance wheel, a pallets, a bridge or bar, an oscillating weight or even a wheel, such as an escape wheel, entirely or partially from fragile or brittle materials.

Preferably, the silicon-based material used to make the compensated balance spring may be single crystal silicon, regardless of its crystal orientation, doped single crystal silicon, regardless of its crystal orientation, amorphous silicon, porous silicon, polycrystalline silicon, silicon nitride, silicon carbide, quartz, regardless of its crystal orientation, or silicon oxide. Of course, other materials may be envisaged, such as glass, ceramics, cermets, metals or metal alloys. Further, the first silicon-based part may also optionally include at least one partial coating of silicon oxide, silicon nitride, silicon carbide or an allotrope of carbon, depending upon the intended applications of the timepiece component.

As explained above, the other part may include the same type of material or another type of material. Therefore, preferably, the other part is metal-based and may include an iron alloy, a copper alloy, nickel or an alloy thereof, titanium or an alloy thereof, gold or an alloy thereof, silver or an alloy thereof, platinum or an alloy thereof, ruthenium or an alloy thereof, rhodium or an alloy thereof, or palladium or an alloy thereof.

Figure 1:
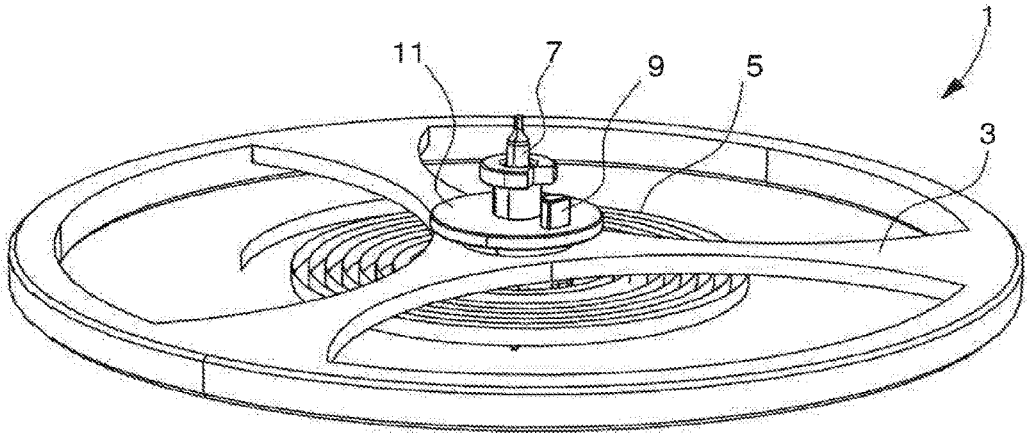
FIG. 1 is a perspective view of a sprung balance resonator.

For the sake of simplicity, the explanation below will concern an assembly between a balance spring and a balance staff. FIG. 1 shows a resonator 1 wherein the balance spring 5 is used for temperature compensation of the entire resonator assembly 1, i.e. all the parts and particularly the balance wheel 3 mounted on the same balance staff 7. Resonator 1 cooperates with a maintenance system, such as, for example, a Swiss lever escapement (not shown) cooperating with the impulse pin 9 of table-roller 11 which is also mounted on staff 7.

Figure 2:
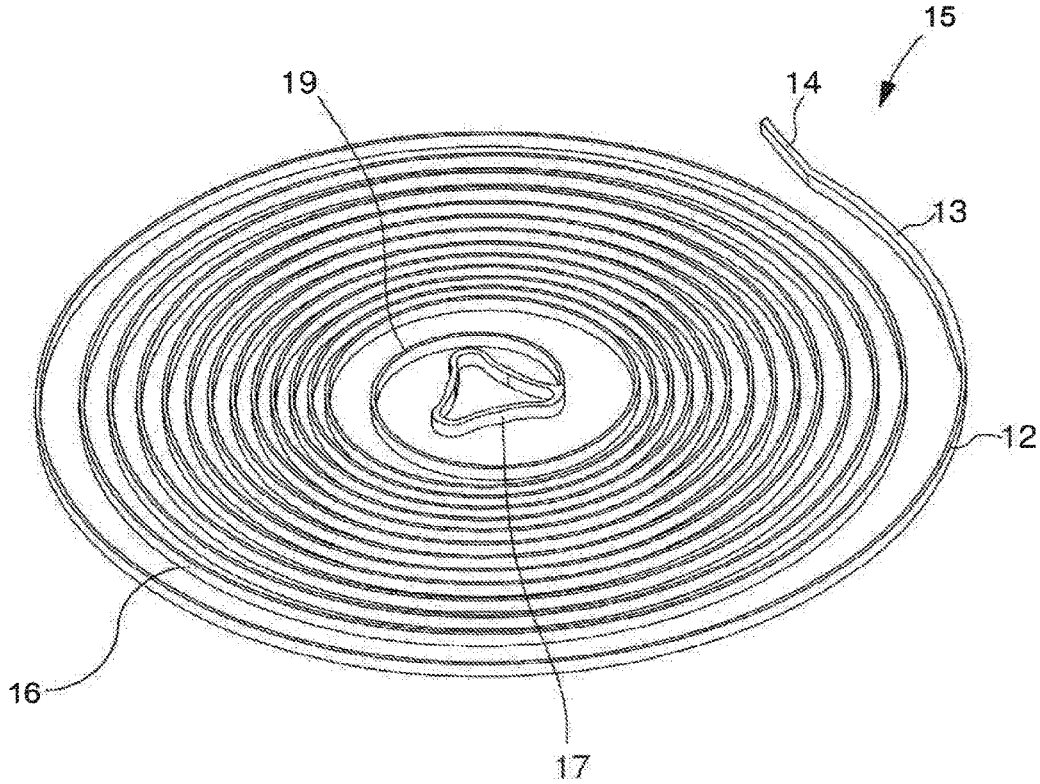
FIG. 2 is a perspective view of a balance spring according to the invention.

A compensating balance spring 15 is shown more clearly in FIG. 2. It includes a single strip 16 wound on itself between an inner coil 19 integral with a collet 17 and an outer coil 12 comprising an end 14 intended to be pinned up to the stud. As seen in FIG. 2, in order to improve the isochronism of the resonator in which balance spring 15 is used, the latter includes an inner coil 19 comprising a Grossmann curve and an outer coil 12 comprising a portion 13 that is thickened relative to the rest of balance spring 15. Finally, it can be seen that collet 17 comprises a single strip extending in a substantially triangular shape so that the collet exhibits elasticity when it is fitted onto the staff, in particular to enable it to be centred relative to the staff.

Figure 3:
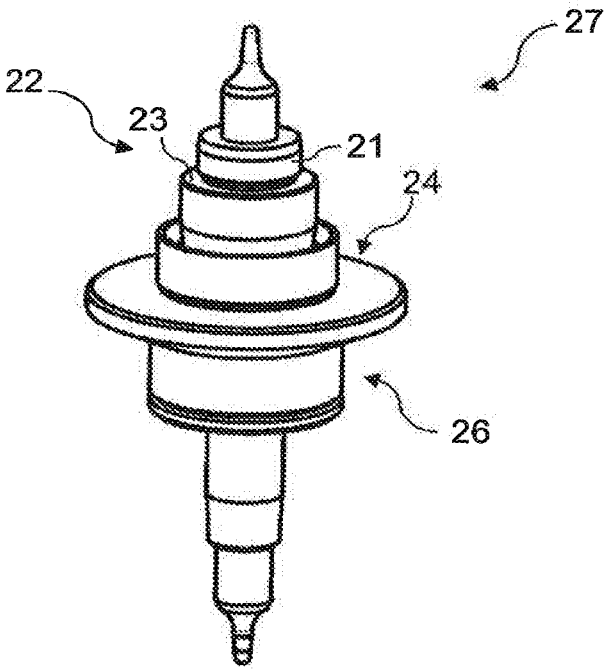
FIG. 3 is a perspective view of a balance staff according to the invention.

A staff 27 is illustrated more clearly in FIG. 3. It includes, in particular, several diameter portions 22, 24, 26 respectively intended to receive the balance spring, the balance wheel and the table-roller. As illustrated in FIG. 3, diameter portion 22 includes a cylindrical shaft 21, the lower portion of which is edged with a shoulder 23.

Figure 4:
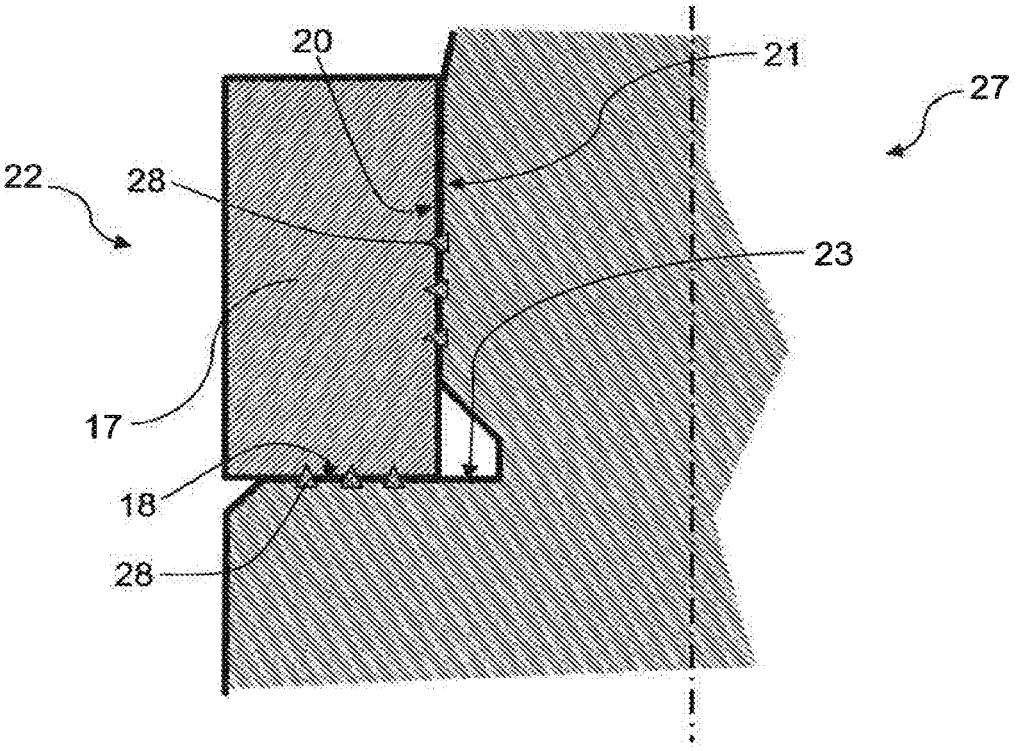
FIG. 4 is a cross-sectional view of an assembly according to WO Publication 2015/185423.

As illustrated in FIG. 4, diameter portion 22 is intended to receive, between shaft 21 and shoulder 23, collet 17 of balance spring 15. More specifically, the inner face 20 of collet 17 is resiliently pressed against the outer surface of shaft 21 and the lower face 18 of collet 17 is pressed against shoulder 23. Finally, as seen at reference 28, shaft 21 and/or shoulder 23 is welded to collet 17 in accordance with the teaching of WO Publication 2015/185423.

However, within the context of developing the teaching of WO Publication 2015/185423, it very soon became clear that the gap between the parts must not exceed 0.5 micrometer, otherwise they cannot be welded together.

According to a first embodiment, the timepiece component comprise a part with a reduced contact surface, or a surface limited to a line of contact, to ensure that the part is fitted in an isostatic configuration onto a member so as to decrease the gap with the member to a value less than or equal to 0.5 micrometer.

Thus, in the first embodiment, the part with an improved welding surface forming a balance spring 35 includes a body, notably forming a collet 37, arranged to cooperate with a member 27 provided with a substantially horizontal surface 23 and a substantially vertical surface 21. According to the first embodiment, part 35 includes at least one face with a substantially rectilinear wall 30 adjacent to an oblique wall 31 so as to reduce the welding surface of the part.

Figure 5:
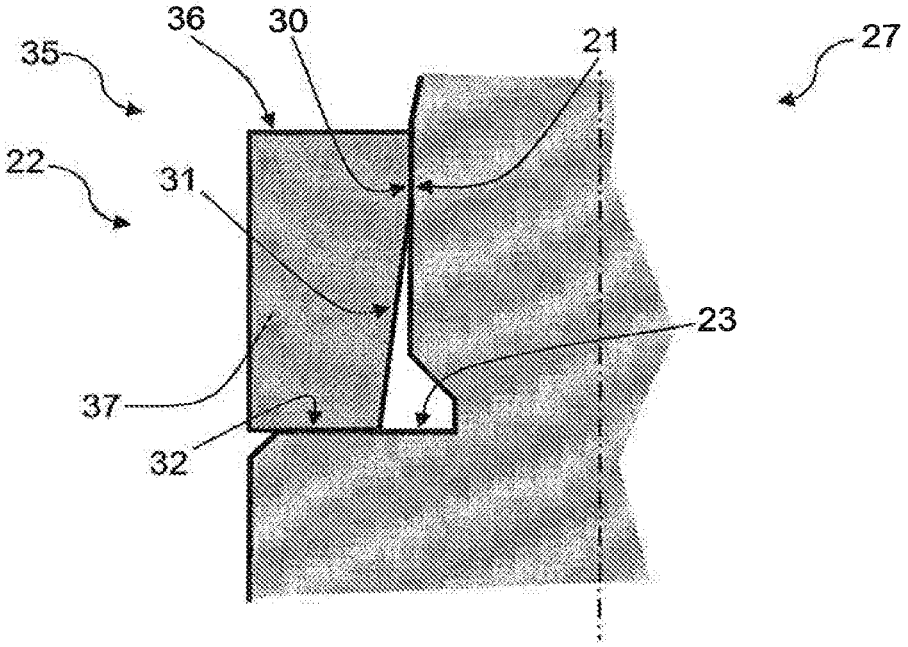
FIG. 5 is a cross-sectional view of an assembly according to a first embodiment of the invention.

As seen in FIG. 5, in comparison to FIG. 4, said at least one face of the part forms an oblique wall 31 that starts from the lower face 32 (intended to be mounted on the substantially horizontal shoulder 23) and then an adjacent substantially rectilinear wall 30 (which is substantially perpendicular to lower face 32) as far as the upper face 36. It is thus understood that lower face 32 has a narrower width than lower face 18 of FIG. 4. Oblique wall 31 thus forms a conical surface.

This first advantage is added to the isostatically configured fit of collet 37 onto staff 27. Indeed, the reduced contact surface of substantially rectilinear face 30 on shaft 21 enables lower face 32 of collet 37 to adapt to the geometry of shoulder 23, i.e. it can follow the geometry of shoulder 23 with greater degree of freedom, in order to diminish the gap between lower face 32 and shoulder 23 to a value less than or equal to 0.5 micrometer. It can be noted that this explanation is also valid between the substantially rectilinear wall 30 and the shaft 21.

Figure 6:
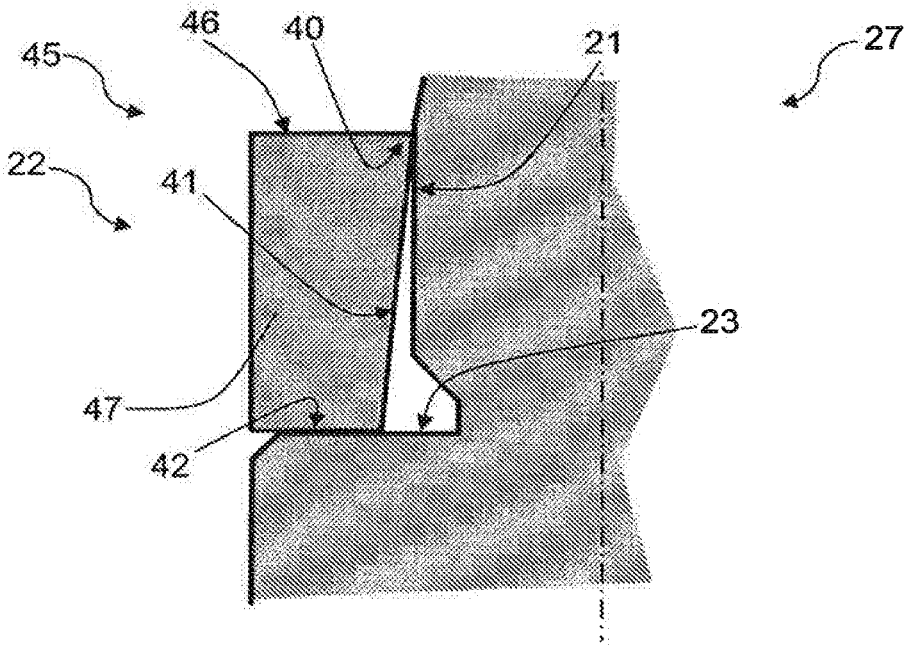
FIG. 6 is a cross-sectional view of an assembly according to a variant of the first embodiment of the invention.

According to a variant illustrated in FIG. 6, oblique wall 41 could even deliberately form virtually all of said at least one face between lower face 42 and upper face 46, so that substantially rectilinear wall 40 almost forms a line of contact with shaft 21 instead of the narrower wall 30 illustrated in FIG. 5. It is understood that oblique wall 41 of collet 47 also forms a conical surface, and balance spring 45 maintains the same combined advantages as the first embodiment of FIG. 5.

Thus, once collet 37, 47 of balance spring 35, 45 is fitted onto diameter portion 22 of staff 27, laser welding between lower face 32, 42 and shoulder 23 is guaranteed since collet 37, 47 offers a reduced lower face 32, 42 and an isostatically configured fit on staff 27 thereby reducing the gap with staff 27 to a value less than or equal to 0.5 micrometer between lower face 32, 42 and shoulder 23.

Further, alternatively or additionally, in the configuration of FIG. 5, it is also possible to weld substantially rectilinear wall 30 onto shaft 21.

According to a second embodiment, the timepiece component comprises a part with a reduced stiff surface, or a surface limited to a line of contact, to ensure that the part is fitted in an isostatic configuration so as to decrease the gap with a member to a value less than or equal to 0.5 micrometer.

Therefore, in the second embodiment, the part with an improved welding surface forming a balance spring 55 comprises a body, notably forming a collet 57, arranged to cooperate with a member 27 provided with a substantially horizontal surface 23 and a substantially vertical surface 21. According to the second embodiment, part 55 includes at least one face with a substantially rectilinear wall 50 that is partially pierced providing additional elasticity in order to ensure that the part is fitted in an isostatic configuration onto the member to improve the welding thereof.

Figure 7:
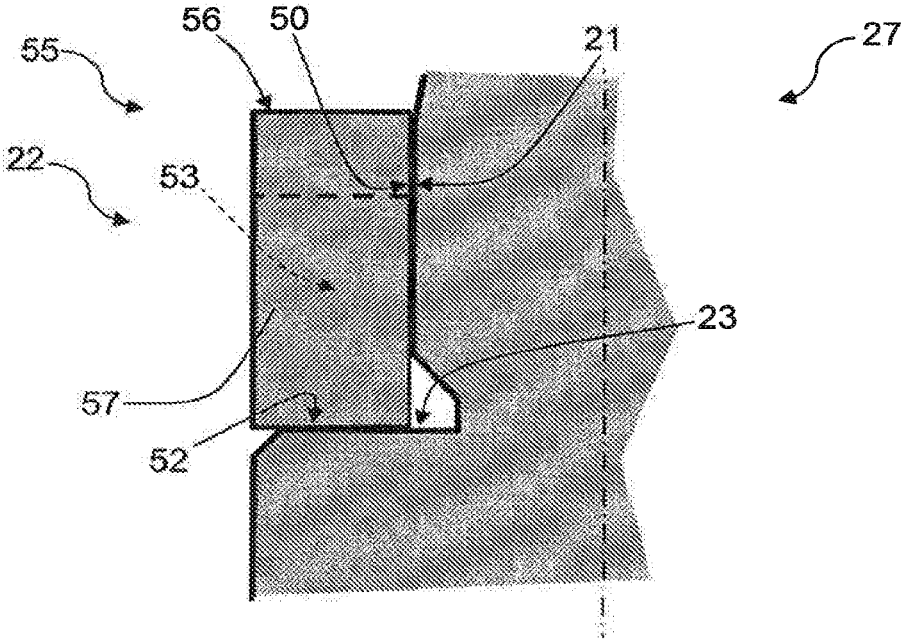
FIG. 7 is a cross-sectional view of an assembly according to a second embodiment of the invention.
Figure 8:
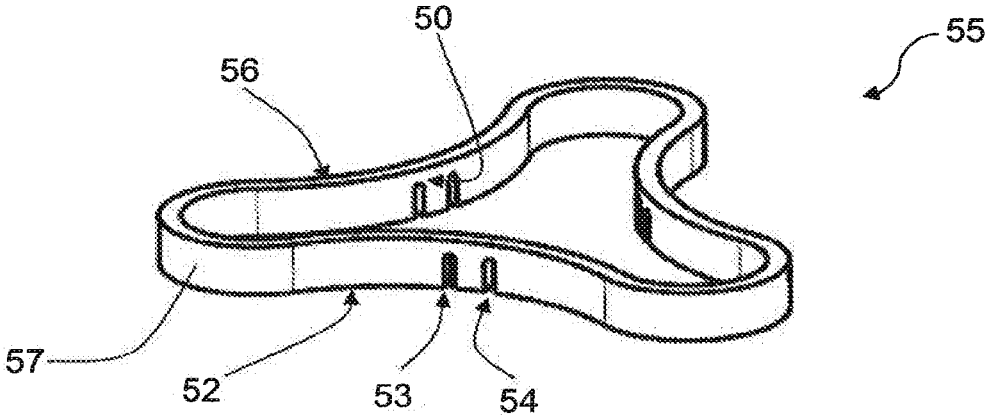
FIG. 8 is a perspective view of a part according to a second embodiment of the invention.

As seen in FIGS. 7 and 8, said at least one face of the part forms a substantially rectilinear wall 50 from lower face 52 (intended to be mounted on substantially horizontal shoulder 23) to upper face 56 which includes pierced holes 53, 54 for decoupling a stiff portion intended to cooperate with shaft 21 and a more elastic portion intended to enable lower face 52 to adapt to the geometry of shoulder 23. It is thus understood that lower face 52 does not have a narrower width regarding the lower face 18 of FIG. 4 but it is capable of deforming to compensate for any unevenness of shoulder 23.

This first advantage is added to the isostatically configured fit of collet 57 onto staff 27. Indeed, the stiff portion forming a reduced contact surface with shaft 21 enables lower face 52 of collet 57 to adapt even better to the geometry of shoulder 23, i.e. it can follow the geometry of shoulder 23 with greater degree of freedom, so as to decrease the gap between lower face 52 and shoulder 23 to a value less than or equal to 0.5 micrometer.

Thus, once collet 57 of balance spring 55 is fitted onto diameter portion 22 of staff 27, laser welding between lower face 52 and shoulder 23 is guaranteed since collet 57 offers a reduced lower face 52 capable of moving to follow shoulder 23 and an isostatically configured fit on staff 27 thereby reducing the gap with the staff 27 to a value less than or equal to 0.5 micrometer between lower face 52 and shoulder 23.

It can be noted that this explanation is also valid between the substantially rectilinear wall 50 and the shaft 21 because, when the lower face 52 is displacing, the more elastic portion of the substantially rectilinear wall 50 moves away from the shaft 21. Consequently, alternatively or additionally, it is also possible to weld the stiff portion of substantially rectilinear wall 50 onto the shaft 21.

Of course, this invention is not limited to the illustrated example but is capable of various variants and modifications which will appear to those skilled in the art. In particular, the first and second embodiments may be combined to take advantage of their combined effects.

Figure 9:
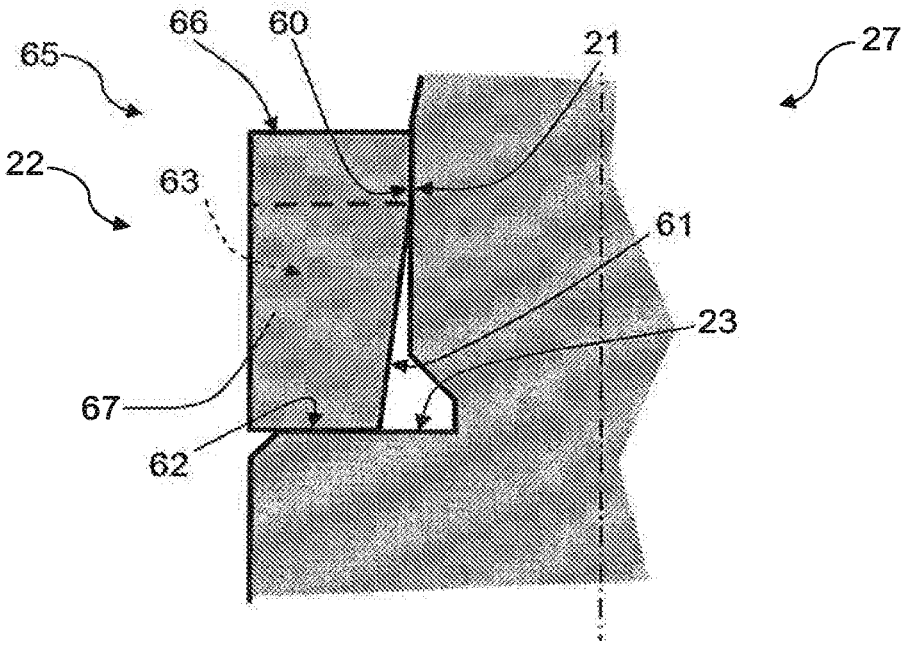
FIG. 9 is a cross-sectional view of an assembly according to a combination of the first and second embodiments of the invention.

Thus, as seen in FIG. 9, said at least one face of the part forming a balance spring 65 may comprise an oblique wall 61 that starts from lower face 62 (intended to be mounted on substantially horizontal shoulder 23) and then an adjacent substantially rectilinear wall 60 (which is substantially perpendicular to lower face 62) as far as upper face 66. It is thus understood that lower face 62 has a narrower width than lower face 18 of FIG. 4.

This first advantage is added to the isostatically configured fit of collet 67 onto staff 27. Indeed, the reduced contact surface of substantially rectilinear face 60 on shaft 21 enables lower face 62 of collet 67 to adapt to the geometry of shoulder 23, i.e. it can follow the geometry of shoulder 23 with greater degree of freedom, in order to diminish the gap between lower face 62 and shoulder 23 to a value less than or equal to 0.5 micrometer. It can be noted that this explanation is also valid between the substantially rectilinear wall 60 and the shaft 21.

It is understood that these first and second advantages are in addition to an elastic portion of collet 67 on staff 27. Indeed, said at least one face 60, 61 of the part forming balance spring 65 may also include pierced holes 63 for separating a stiff portion 60 intended to cooperate with shaft 21 and a more elastic portion 61 intended to enable lower face 62 to even better adapt to the geometry of shoulder 23. Indeed, the more elastic portion 61 is capable of deforming to compensate for any unevenness of shoulder 23.

Thus, once collet 67 of balance spring 65 is fitted onto diameter portion 22 of staff 27, laser welding between lower face 62 and shoulder 23 is guaranteed since collet 67 offers a reduced lower face 62 capable of moving to follow shoulder 23 and an isostatically configured fit on staff 27 thereby reducing the gap with the staff 27 to a value less than or equal to 0.5 micrometer between lower face 62 and shoulder 23.

Of course, alternatively or additionally, it is also possible to weld the stiff portion of substantially rectilinear wall 60 onto the shaft 21

What is claimed is:

1. A timepiece component comprising:

a member provided with a substantially horizontal surface and a substantially vertical surface; and a part fitted and welded onto the member, wherein the part includes at least one face with a substantially rectilinear wall adjacent to an oblique wall to ensure that the part is fitted in an isostatic configuration to improve the welding thereof onto the member, wherein the oblique wall is formed on the part to extend between the substantially horizontal surface and the substantially vertical surface when the part is fitted onto the member, and wherein the member is part of a balance staff and the part is part of a balance spring.

2. The timepiece component according to claim 1, wherein the at least one face of the part is fitted onto the substantially vertical surface of the member.

3. The timepiece component according to claim 1, wherein the at least one face of the part is fitted onto the substantially horizontal surface of the member.

4. The timepiece component according to claim 1, wherein the part is made from silicon or from ceramic.

5. The timepiece component according to claim 1, wherein the part also includes at least a partial coating of metal, silicon oxide, silicon nitride, silicon carbide or an allotrope of carbon.

6. The timepiece component according to claim 1, wherein the member includes an iron alloy, a copper alloy, nickel or an alloy thereof, titanium or an alloy thereof, gold or an alloy thereof, silver or an alloy thereof, platinum or an alloy thereof, ruthenium or an alloy thereof, rhodium or an alloy thereof, or palladium or an alloy thereof.

7. The timepiece component according to claim 1, wherein a shaft of the balance staff includes the substantially vertical surface and a shoulder of the balance staff includes the substantially horizontal surface.

8. The timepiece component according to claim 1, wherein a collet of the balance spring includes the substantially rectilinear wall and the oblique wall.

9. A timepiece component comprising:

a member made of a single homogeneous material and provided with a substantially horizontal surface and a substantially vertical surface; and a part fitted and welded onto the member, the part including a substantially horizontal wall and a substantially vertical wall between which an oblique wall extends to ensure that the part is fitted in an isostatic configuration, wherein, when the part is fitted onto the member, the substantially horizontal wall and the substantially vertical wall are configured to abut the substantially horizontal surface and the substantially vertical surface respectively, and wherein an enclosed space is bounded at least in part by the oblique wall, the substantially horizontal surface and the substantially vertical surface.

10. The timepiece component according to claim 9, when the part is fitted onto the member, the substantially horizontal wall and the substantially vertical wall are welded to the substantially horizontal surface and the substantially vertical surface respectively.

11. A timepiece component comprising:

a monolithic member provided with a substantially horizontal surface and a substantially vertical surface; and a part fitted and welded onto the member, the part including a substantially horizontal wall and a substantially vertical wall between which an oblique wall extends to ensure that the part is fitted in an isostatic configuration, wherein, when the part is fitted onto the member, the substantially horizontal wall and the substantially vertical wall are configured to abut the substantially horizontal surface and the substantially vertical surface respectively, and wherein an enclosed space is bounded at least in part by the oblique wall, the substantially horizontal surface and the substantially vertical surface.

12. The timepiece component according to claim 11, when the part is fitted onto the member, the substantially horizontal wall and the substantially vertical wall are welded to the substantially horizontal surface and the substantially vertical surface respectively.

* * * * *